US009090097B2

(12) United States Patent
Sarbjit et al.

(10) Patent No.: US 9,090,097 B2
(45) Date of Patent: Jul. 28, 2015

(54) INKJET PRINTER WITH SELECTABLE SIMPLEX AND DUPLEX PRINTING

(71) Applicant: Delphax Technologies Inc., Bloomington, MN (US)

(72) Inventors: Parhar Sarbjit, Mississauga (CA); Ke Li, Etobicoke (CA); Robert McCallum, Caledon (CA)

(73) Assignee: Delphax Technologies Inc., Bloomington, MN (US)

( * ) Notice: Subject to any disclaimer, the term of this patent is extended or adjusted under 35 U.S.C. 154(b) by 0 days.

(21) Appl. No.: 13/886,044

(22) Filed: May 2, 2013

(65) Prior Publication Data

US 2014/0327724 A1 Nov. 6, 2014

(51) Int. Cl.
*B41J 3/60* (2006.01)
*B41J 11/00* (2006.01)

(52) U.S. Cl.
CPC .. *B41J 3/60* (2013.01); *B41J 11/002* (2013.01)

(58) Field of Classification Search
None
See application file for complete search history.

(56) References Cited

U.S. PATENT DOCUMENTS 5,568,246 A 10/1996 Keller et al.
2011/0243634 A1 10/2011 Kagami et al.

FOREIGN PATENT DOCUMENTS

EP 1464506 A2 10/2004
JP 2005067794 A 3/2005

OTHER PUBLICATIONS

JP2005067794A text translation, Mar. 17, 2005.

*Primary Examiner* — Justin Seo
(74) *Attorney, Agent, or Firm* — Stuart L. Wilkinson

(57) ABSTRACT

A method and apparatus for selectable duplex and simplex printing of sheet or web media has a selection mechanism for switching between the printing modes. The selection mechanism includes guides which determine whether a medium follows a long transport path or a short transport path between an input zone and an output zone. In the first transport path, the medium is transported past a first inkjet printhead for printing onto a surface of the medium. In the second transport path, the medium is transported past a second inkjet printhead for printing onto one surface of the medium, then turned and transported past the first inkjet printhead for printing onto the other surface of the medium.

15 Claims, 6 Drawing Sheets

INKJET PRINTER WITH SELECTABLE SIMPLEX AND DUPLEX PRINTING

FIELD OF THE INVENTION

This invention relates to an industrial grade inkjet printer for providing selective simplex (one-sided) and duplex (two sided) printing of a medium and to a method of printing therefore.

BACKGROUND OF THE INVENTION

It is desirable in high speed printers to be able to print cut sheets at a rate of the order of 140 feet per minute. Such a requirement is made more difficult if there is a requirement for duplex printing. It is known in duplex inkjet printers to perform duplex printing by passing a cut sheet into a printing dock under the inkjet printhead, to print one side, to withdraw the cut sheet from the printing dock, turn the cut sheet over, transport the inverted sheet back into the printing dock under the printhead, print the other side, and then direct the duplex printed sheet to an output. The various operations, and in particular the sheet insertions and extractions, take time and detract from the throughput speed. It is desirable either to obviate or modify some of the steps in order to achieve faster duplex and simplex performance with easy selection of the desired printing mode.

SUMMARY OF THE INVENTION

According to one aspect of the invention, there is provided a printer for selective duplex and simplex printing on a medium, comprising an input zone and an output zone, a transport mechanism having a selectable first transport path for transporting a medium from the input zone to the output zone past a first print station for printing on one surface of the medium by a first inkjet printhead, the transport mechanism having a second selectable transport path including a substantial part of the first transport path for transporting a medium from the input zone to the output zone past a second print station for printing on one surface of the medium by a second inkjet printhead and then past the first print station for printing on the reverse surface of the medium by the first ink jet printhead, the first and second transport paths including a first generally horizontal span at a first height, the first inkjet printhead positioned to jet ink down onto the medium as it is transported in a first direction along the first generally horizontal span, the second transport path including a second generally horizontal span at a second height, the second inkjet printhead positioned to jet ink down onto the medium as it is transported in a second direction opposite to the first direction along the second generally horizontal span.

Preferably the printer further comprises a turn unit to turn a medium between the horizontal spans. The first and second generally horizontal spans can be vertically adjacent horizontals limbs of a generally S-form path.

The printer can further include a drying unit mounted downstream of at least one of the inkjet printheads.

For printing on a sheet medium, the printer can further comprise a first diverter drivable between a first position for passing sheet media from the input zone onto the first transport path and a second position for passing sheet media from the input zone onto the second transport path and a second diverter drivable between a third position for directing sheet media transported on the first transport path towards the output zone and a fourth position for directing sheet media transported on the second transport path towards the output zone.

The printer can further comprise at least one continuous belt for transporting the sheet media along at least one of the generally horizontal spans.

For printing on a web medium, the printer can further comprise a plurality of rollers positioned to guide a driven web from the input zone to the output zone on the second transport path, a subset of the plurality of rollers positioned to guide a driven web from the input zone to the output zone on the first transport path. The printer can further comprise idler rollers to support the web at the inkjet printheads.

Preferably the printer further comprises a first priming unit and a first drying unit for priming and drying one surface of a medium transported on the first transport path and for priming and drying one surface of a medium transported on the second transport path, the printer having a second priming unit and a second drying unit for priming and drying a reverse surface of a medium transported on the second transport path.

For added versatility, the printer can have first common transport elements operable to transport both sheet media and web media, second transport elements selectively operable to transport sheet media but not web media, and third transport elements selectively operable to transport web media but not sheet media.

BRIEF DESCRIPTION OF THE DRAWINGS

For simplicity and clarity of illustration, elements illustrated in the following figures are not drawn to common scale. For example, the dimensions of some of the elements are exaggerated relative to other elements for clarity. Advantages, features and characteristics of the present invention, as well as methods, operation and functions of related elements of structure, and the combinations of parts and economies of manufacture, will become apparent upon consideration of the following description and claims with reference to the accompanying drawings, all of which form a part of the specification, wherein like reference numerals designate corresponding parts in the various figures, and wherein:

DETAILED DESCRIPTION OF THE INVENTION INCLUDING THE PRESENTLY PREFERRED EMBODIMENTS

Figure 1:
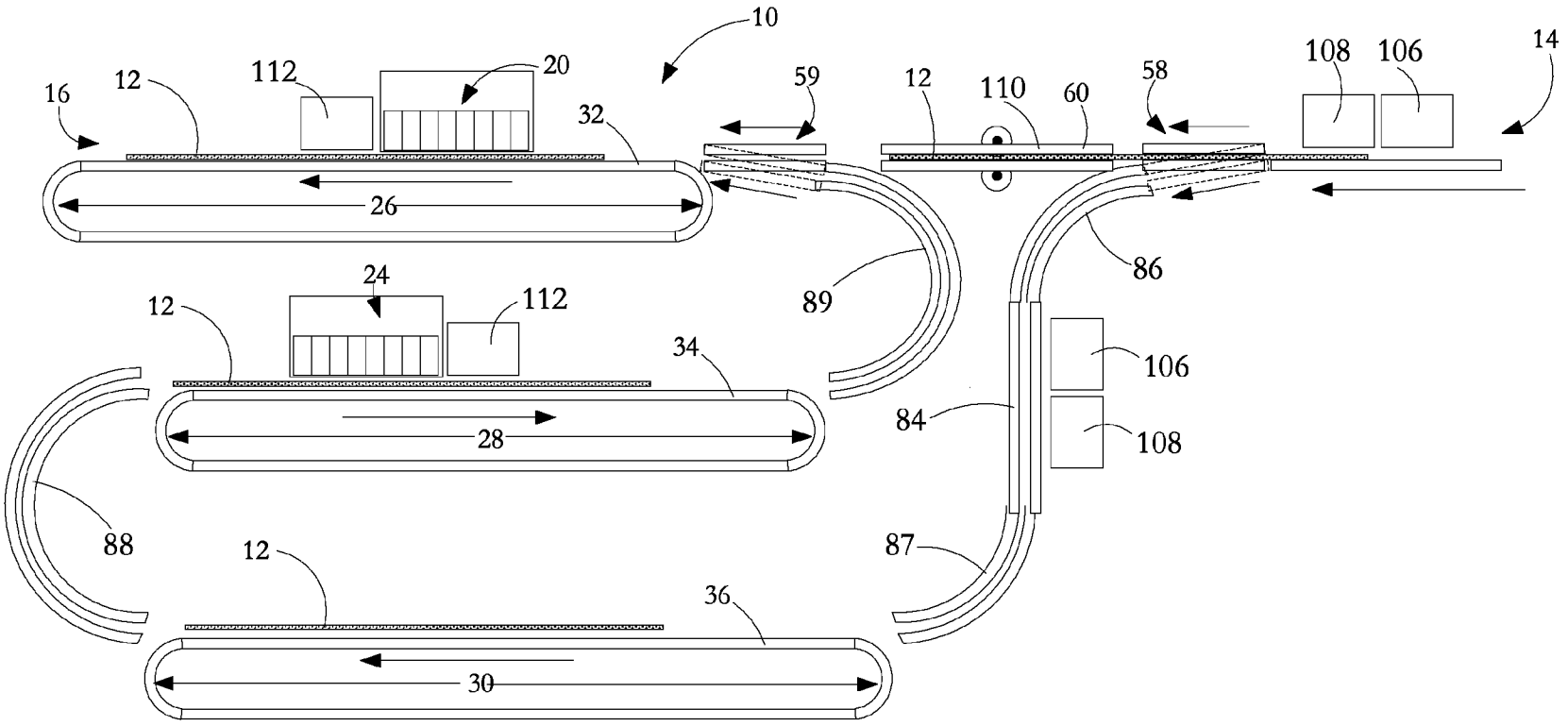
FIG. 1 is a side view of printing apparatus according to one embodiment of the invention.

Referring to FIG. 1, there is shown in side view a printing apparatus according to one embodiment of the invention. The apparatus has a transport mechanism which takes sheet media such as cut paper sheets from an input zone to an output zone. The transport mechanism presents two possible transport paths: one for sheets that are to be printed on one side only—simplex printing—and the other for sheets that are to be printed on both sides—duplex printing. The shorter transport path takes sheet media though a first print station having printheads for simplex printing one side of the sheet media. The longer transport path embraces much of the shorter path, but takes the sheet media through a second print station having printheads for printing on one side of the sheet media and then takes that sheet through the first print station for printing on the reverse side of the sheet media. The longer path has an S-form with the printheads located at horizontal spans which would be the upper and middle horizontal limbs of the S. A suitable ink delivery system adapted for delivering ink to the multiple level printheads is described in copending U.S. Provisional Patent Application Ser. No. 61/642,310 (Ink delivery system for inkjet print heads) filed May 3, 2012, the contents of which are hereby incorporated by reference in their entirety and made part of the present United States Patent Application.

The transport paths, including the input and output zones, utilize a combination of nips, guides and belts to act on transported sheets to move them through the apparatus. The horizontal spans have respective endless conveyor belts to convey the sheets along the span. A suitable belt and associated drive and control apparatus are as described in copending U.S. patent application Ser. No. 13/368,280 (Multiple print head printing apparatus and method of operation) filed Feb. 7, 2012, the contents of which are hereby incorporated by reference in their entirety and made part of the present United States Patent Application. Such printing apparatus has a series of inkjet print heads spaced from one another in a transport direction. A continuous belt driven around a roller system is used to feed sheet media successively to the print heads so that a partial image printed by one print head is overprinted at a subsequent print head with registration of the partial images. A sheet medium is caused to become electrostatically tacked to the belt by passing the sheet past a charging device. Movement of the belt is tracked by a tracking sub-system and operation of the print heads is coordinated with the tracked belt movement to achieve precise registration of the partial images.

Figure 2:
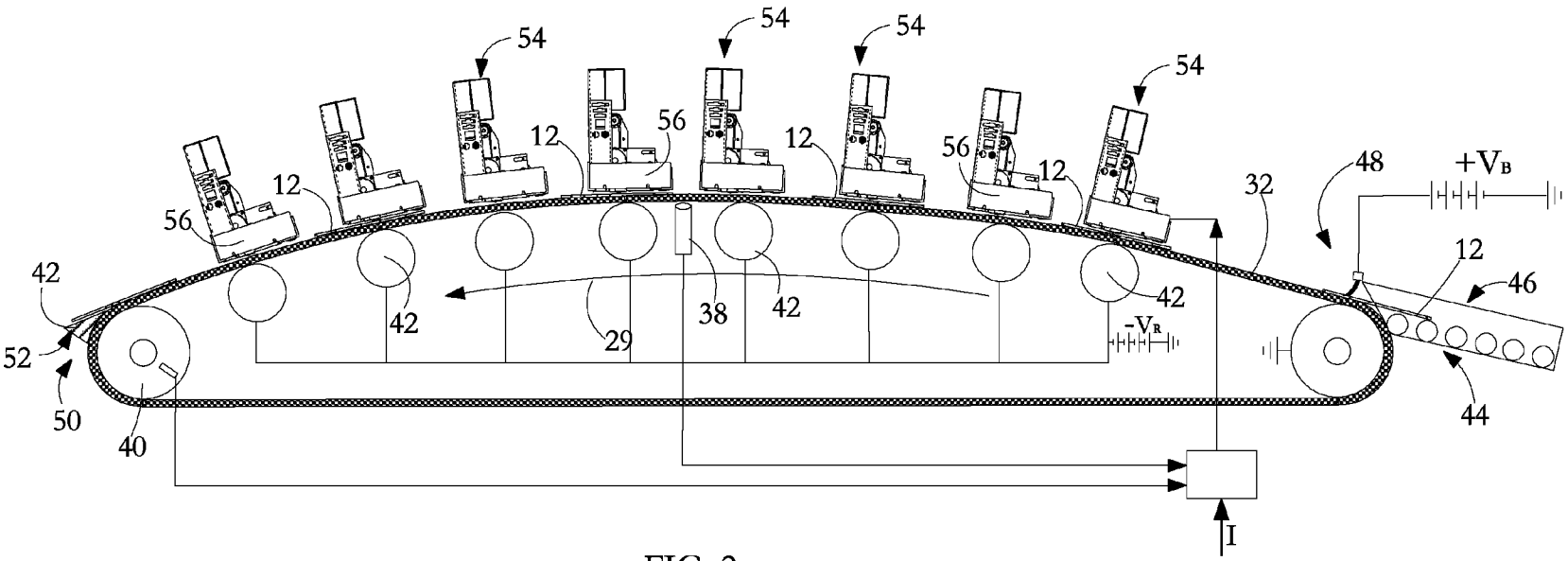
FIG. 2 is a side view of a belt span suitable for use in the apparatus of FIG. 1

The electrostatic belt arrangement is particularly useful for conveying the sheet media along the upper and middle spans of the S form transport path although a simpler conveyor belt arrangement can be contemplated for the lower span. Referring in detail to FIG. 2, there is shown sheet transport equipment for one span of the S-form transport path. The sheet transport equipment has a continuous belt 32 driven by a drive roller 40 around a series of idler rollers 42. At an input region, shown generally as 44, there is a sheet alignment sub-system 46 and a charge transfer sub-system 48. At an output zone shown generally as 50, is a paper sheet stripper arrangement 52. Each of the idler rollers 42 is located adjacent a corresponding inkjet print engine 54 each print engine 54 containing an inkjet printhead 56 and mechanical, electrical and fluidic hardware needed to position and operate the printhead. The inkjet print engine array comprises eight print engines arranged in two staggered banks of four print engines. As shown in this side view, the print engines of each bank are arranged in a wide diameter arc with each print engine facing the belt where the belt 32 passes over an associated idler roller 42. On the face of each printhead 56 are nozzles having exit openings that are spaced from the upper surface of the belt by ½ to 1 millimeter. By tensioning the continuous belt 32 over the arrangement of rollers 42, the printhead to belt spacing is maintained at a comparatively unvarying distance. The belt 32 is made of Mylar®, an electrical insulator having a high dielectric strength which is important because during a printing operation, cut paper sheets 12 are maintained in position on the belt 32 by being electrostatically tacked to the belt. Charge is imparted to the cut paper sheets 12 as they are launched onto the belt 32 by the charge transfer sub-system 48. In the course of a printing operation, the cut sheets 12 are conveyed from right to left as shown in FIG. 2 and as they pass under the array of inkjet printheads 56, the printheads are operated to print partial images on the transported sheets. By ensuring accurate positioning and tracking of the electrostatically tacked sheets 12, accurate high resolution composite images can be obtained consisting of superimposed partial images from successive printheads 56. Such a belt transport arrangement is used in each of the horizontal spans 26, 28 of the S-form transport path. While electrostatic tacking of the sheets 12 to a conveyor belt 32, 34 is preferred, other arrangements are possible for moving sheets to be printed through an S-form path. Also, while the transport mechanism shown has the input and output zones 14, 16 adjacent the top span 26 of the S-form path, the input and output zones 14, 16 can alternatively be adjacent the bottom span 30 or can be at different heights.

Figure 3:
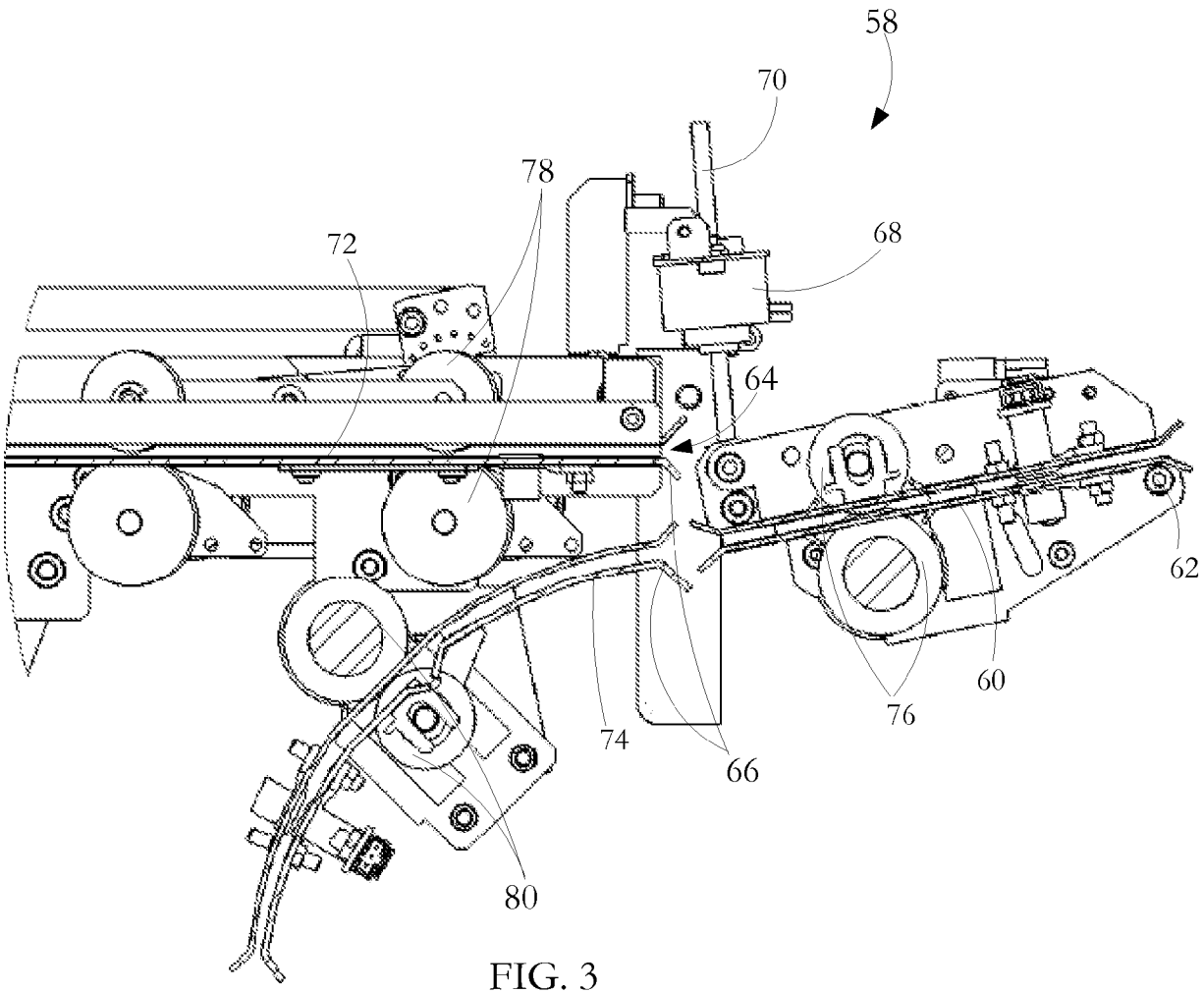
FIG. 3 is a side view of a diverter mechanism suitable for use in the apparatus of FIG. 1.

The transport mechanism includes diverters 58, 59. As shown in the detail view of FIG. 3, each diverter has a parallel plate sheet guide 60 hingedly mounted on a shaft 62. The parallel plate guide 60 defines a slot 64 at each end for sheet entry and exit. At the entrance and exit locations, the plates are formed with lips 66 to aid sheet entry and exit. The diverter 58 can be moved between limit positions upon operation of a linear actuator drive unit 68. The solenoid drive unit 68 is operable to axially drive a shaft 70, the other end of which is connected to the parallel plate guide 60 to drive the guide about hinge shaft 62. In a first position (the down position), such position being shown in FIG. 3 and in broken line in FIG. 1, the exit region of the diverter 58 is positioned to direct a sheet medium 12 passing through the diverter from right to left onto a path including the guide 74. In a second position (the up position, such position not being shown in FIG. 3 and in full line in FIG. 1) the exit region of the diverter 58 is positioned to direct a sheet medium 12 passing through the diverter 58 from right to left onto a path including a guide 72. Sheets are driven though the parallel plate guide 60 of the diverter by a nip 76. Corresponding nips 78, 80 are associated with guides 72, 74 and function to draw a sheet 12 from the diverter 58 into a respective one of the guides 72, 74.

Referring back to FIG. 1, one such diverter 58 is positioned immediately downstream of the input zone in the shorter transport path. When the diverter 58 is in the up position, this corresponds to the transported sheet 12 being driven on the shorter transport path essentially in a straight-through track on the top horizontal span 26 of the S-form transport equipment. When the diverter 58 is in the down position, this corresponds to the transported sheet 12 being driven on the longer transport path commencing with a downward leg 84 taking the sheet 12 from the input zone 14 to the bottom span 30 of the S-form transport equipment. The diverter 58 is moved between the up and down positions to select for simplex and duplex printing of a sheet 12.

The transport includes a second diverter 59 which is in a reverse orientation compared with the diverter 58 and is spaced from it by a bridging span 110 having one of more sheet transfer nips for moving sheet media 12 from the diverter 58 to the diverter 59. The bridging span forms a part of the shorter transport path. The diverter 59 when in the down position receives sheet media transported to the diverter 59 along the longer transport path, and when in the up position, receives sheet media transported along the shorter transport path for simplex printing.

Figure 4:
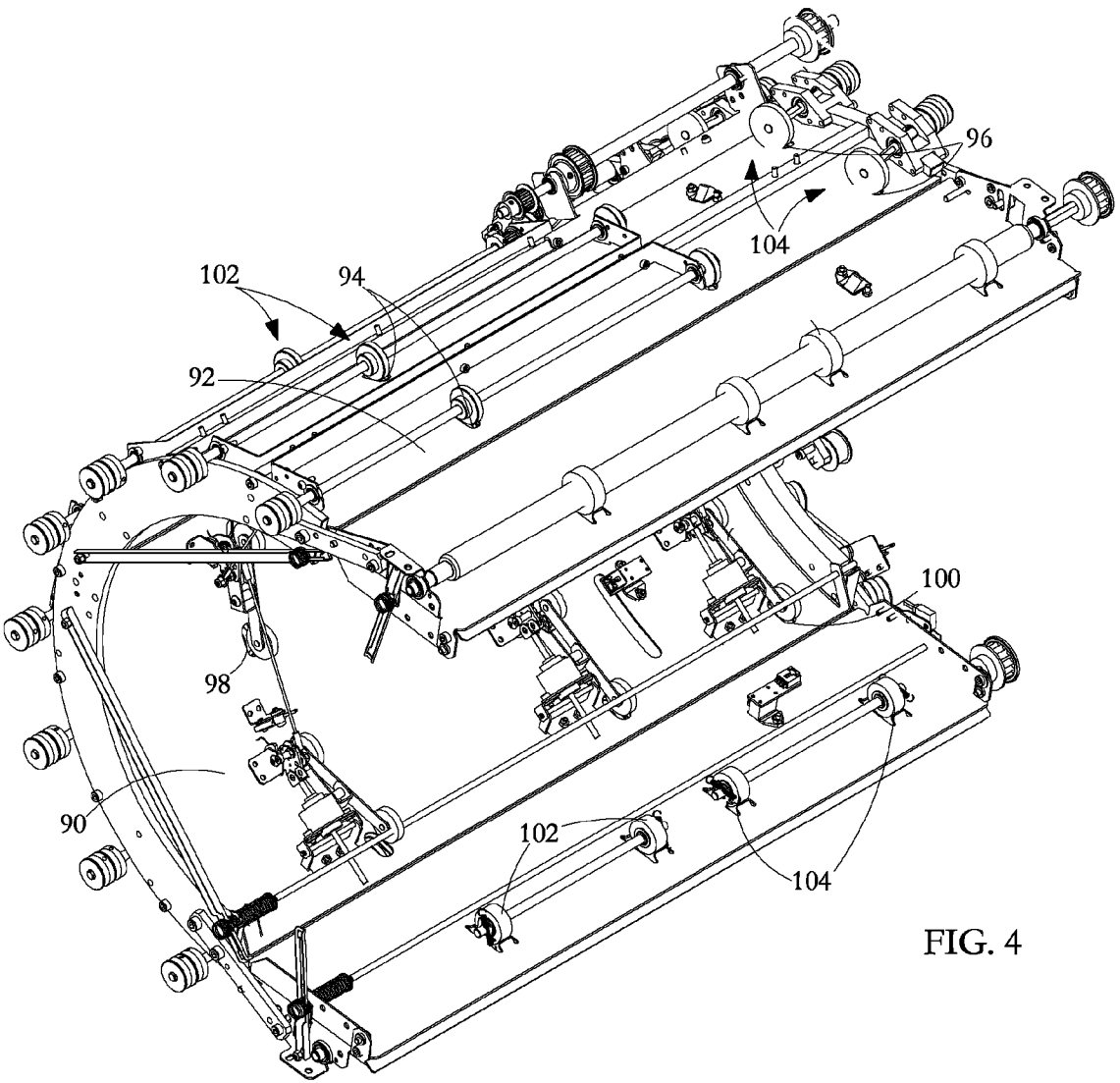
FIG. 4 is a curved registration unit, such diverter suitable for use in the apparatus of FIG. 1.

The transport mechanism includes 180 degree turn units 88, 89 and 90 degree turn units 86, 87. The turn units are of the form shown in copending U.S. patent application Ser. No. 13/439,909 (Registration and transport unit for a sheet feeder) filed Apr. 5, 2012, the contents of which are hereby incorporated by reference in their entirety and made part of the present United States Patent Application for all purposes. As shown in FIG. 4, a turn unit 88 has a pair of plates 90, 92 mounted in parallel relationship. The plates 90, 92 are spaced apart to leave a slot along which sheet media are to be transported, and are curved so as to turn the transported sheet media through the desired angle. The plate 90 has apertures 94, 96 distributed over its area, the apertures being aligned with corresponding apertures 98, 100 in the plate 92. At each set of aligned apertures is mounted a roller pair 102, 104 comprising a drive roller on the outside of the curve and an idler roller on the inside of the curve. In use, the roller pairs each form a nip for gripping a sheet located in the slot and the drive roller of each pair is used to drive the sheet along the slot.

The printer also includes a pair of priming fluid applicator units 106. The function of the units 106 is to coat sheets 12 such as cut paper sheets with a coating of fluid as the paper is transported through the units. Application of the priming fluid acts to present a layer of material on the sheet that means that subsequently jetted inks result in a higher quality image than would be the case if no primer were used. For example, the primer may increase the waterfastness of certain inks in comparison with printing onto paper without primer. Alternatively, or in addition, the primer may improve the colour gamut. The priming fluid is applied with a roller although other suitable means may be adopted. Each priming unit has a dryer 108 positioned immediately downstream of the primer applicator unit to dry the applied priming fluid before the coated sheet 12 is further manipulated.

One primer applicator unit 106 is located in the input zone 14 and is used to prime the surface of a sheet medium 12 moving from right to left through the zone 14, regardless of whether the sheet is to be printed on one side or both. The other primer applicator unit 106 is located in the downward span 84 additionally to coat the reverse side of sheets 12 that are destined to be duplex printed. Both of the primer applicator units 106 have associated dryers 108 to dry the applied primer coat. The dryer units are radiant heater dryers having a pair of twin carbon filament bulbs extending across the full width of the printing apparatus to accommodate double page width sheets.

In operating the printer, the first step that is performed is to decide whether the sheet is to be simplex printed or duplex printed. If that decision is simplex printing, the two diverters 58 are driven to their up positions. Sheet material 12 to be printed is driven from the right as shown into the input zone 14. A first of the priming fluid applicators 106 is then operated to coat the upper side of the sheet 12 with priming fluid and the dryer in the input zone is operated to dry the applied coating. The sheet 12 is then driven by nips into the diverter 58 which directs the sheet into the guide 72 which forms part of a bridging span 110, forming a part of the shorter transport path, where it is registered against a side reference member (not shown). Re-referencing of the side edge of the sheet 12 is repeated periodically as the sheet is transported through the equipment. The sheet 12 is driven by a further nip or nips associated with a bridging span to the reverse oriented diverter 59 onto the continuous belt 32 occupying the top span 26 of the S-form transport mechanism. The sheet medium 12 is electrostatically tacked to the belt 32 which then conveys the sheet 12 under an array 20 of inkjet printheads which operate in sequence to print a composite image onto the sheet 12. The image is dried at a dryer 112 which is similar to the dryer 108. The printed sheet 12 is then conveyed by further nips from the belt 32 to the output zone 16. The sheet medium 12 throughout its movement though the transport equipment is monitored by optical sensors which determine any problem caused by a paper jam and can be used to ensure that the sheet media are properly aligned.

If the decision is duplex printing, the two diverters 58, 59 are driven to their down positions. Sheet material 12 to be printed is again driven from the right as shown into the input zone 14 and the priming fluid application unit 106 and the dryer 108 associated with the input zone are operated in a similar manner as for simplex printing to prime one surface of the sheet 12. The sheet 12 is then driven into the diverter 58 which directs the sheet into the 90 degree curved guide 86. Nips associated with the curved guide drive the sheet downwardly to a reverse 90 degree curved guide 87. In between the two 90 degree curved guides 86, 87, the sheet passes through a second priming fluid applicator unit 106 and its associated dryer 108 to impart a primer coating to the unprimed surface of the sheet 12. From the lower 90 degree curved guide 87, the sheet is launched onto the lowest span 30 of the S-form transport path. At the end of the span 30, the leftward driven sheet 12 is turned though 180 degrees at a 180 degree curved guide 88 and launched onto the middle span 28 of the S-form transport path. The sheet medium 12 is electrostatically tacked to the belt 34 which then conveys the sheet 12 under an array 24 of inkjet printheads which operate in sequence to print a composite image onto one surface of the sheet 12. The image is dried at a dryer 112 similar to the dryer 108. At the end of the middle span 28, the rightwardly driven sheet is turned though a reverse 180 degrees at another curved guide 89. At the output end of the curved guide 89, the transported sheet is directed into the reverse oriented diverter 59 and onto the continuous belt 32 of the top span 26 of the S-form transport mechanism. The sheet is registered against a side reference plate at each of the curved guides 88, 89. As shown in FIG. 2, the sheet medium 12 is electrostatically tacked to the belt 32 which then conveys the sheet 12 under the upper array of inkjet printheads 56 which operate in sequence to print a composite image onto the reverse surface of the sheet. Once the image is complete, it is dried at another drier 112 which is similar to the dryer 108 and then is directed to and through the output zone 16 in the same manner as simplex printed sheets.

Figure 5:
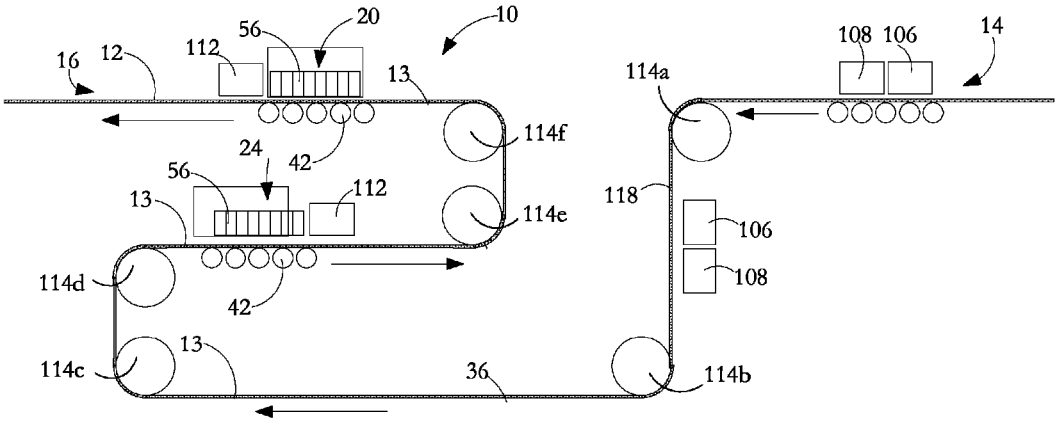
FIG. 5 is a side view of printing apparatus according to another embodiment of the invention, the apparatus configured for duplex web printing.
Figure 6:
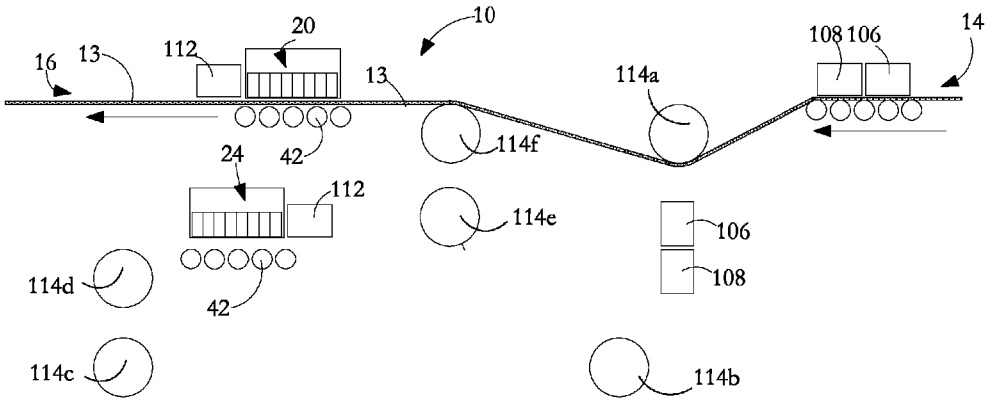
FIG. 6 is a side view of the printing apparatus of FIG. 5, the apparatus configured for simplex web printing.

Referring to FIGS. 5 and 6, there are shown side views of printing apparatus according to another embodiment of the invention. The apparatus has a transport mechanism which takes a web medium such as a paper web 13 from an input zone 14 to an output zone 16. The transport mechanism, as shown in the FIG. 5 configuration, provides a transport path for duplex printing of the web 13, while the transport mechanism, as shown in the FIG. 6 configuration, provides a transport path for simplex printing. The shorter simplex transport path takes the web 13 though a first print station having a printhead array 20 for simplex printing. The longer transport path embraces much of the shorter path, but takes the web 13 through a second print station having a printhead array 24 for printing on one side of the web and then takes the web 13 through the first print station for printing on the reverse side of the web. The longer path has an S-form with the printhead arrays 20 and 24 located respectively at the upper and middle horizontal limbs of the S. The transport paths, including the input and output zones, utilize a combination of idler rollers 114 and 42 to guide and support the web 13 as it is driven through the printing apparatus. The inkjet print engine and printhead array at each of the upper and lower levels of the printer can be essentially as described with reference to the embodiment of FIG. 1.

In the course of a printing operation, the web 13 is conveyed from right to left as shown in FIGS. 5 and 6 and as it passes under the inkjet printhead arrays 20, 24 at the respective printing stations, the printheads are operated to print partial images on the transported sheets. By ensuring accurate positioning and tracking of the web 13, accurate high resolution composite images can be obtained consisting of superimposed partial images from successive printheads at each station. It will be appreciated that while the transport mechanism shown in FIGS. 5 and 6 has the input and output zones 14, 16 adjacent the top span of the S-form path, the input and output zones 14, 16 can alternatively be adjacent the bottom span or can be at different heights.

The idler rollers 114 are brought into service for duplex printing by threading the web 13 around them. In one threading technique, a leading end of the web is threaded successively around the rollers 114*a* to 114*f*. In an alternative technique, the rollers 114*a* to 114*f* are mounted on a laterally slidable carriage and a portion of the web 13 between the belts is held temporarily in a position where the carriage can be slid into place for duplex printing with the intervening web portion draped around the idler rollers 114. The web is then tensioned to tighten it around the rollers before web transportation and printing begins.

The array of rollers 114 is arranged to bring the web 13 through a transport path configured substantially the same as the sheet transport path of FIG. 1. Thus, as in the FIG. 1 embodiment, the printer also includes a pair of priming fluid applicator units 106 for coating a surface of the web with priming fluid as the web is transported past the priming units. Each priming unit has an associated dryer 108 positioned immediately downstream to dry the applied priming fluid. One primer applicator unit 106 is located in the input zone 14 and is used to prime the surface of the web 13 as it moves through the zone 14, regardless of whether the web is to be printed on one side or both. The other primer applicator unit 106 is located adjacent a downwardly extending web span 118 to coat any web 13 that is destined to be duplex printed.

In operating the printer for simplex printing, the web 13 is driven from the right as shown into the input zone 14 and is guided in a direct route between the idler rollers 114*a* and 114*f*. The first priming fluid applicator 106 at the input zone is operated to coat the upper side of the web 13 with priming fluid and its associated dryer 108 is operated to dry the applied coating. The tensioned web 13 is supported by idler rollers 42 as it is fed along the top span of the S-form transport path and under the printhead array 20. The printheads operate in sequence to print a composite image onto the web 13 and the image is dried at dryer 112.

For a duplex printing operation, once the web 13 is in place around the rollers 114, it is driven from the right into the input zone 14 and the first priming fluid application unit 106 and dryer 108 are operated to prime and dry one surface of the web 13. The web 13 is guided around roller 114*a* and downwardly past the second priming fluid applicator 106 and dryer 108 which are operated to prime and dry a reverse side of the web 13. The web is guided around the roller 114*b* and directed along the lowest span of the S-form transport path. The web is then turned though 180 degrees at the pair of rollers 114*c*, 114*d* and directed along the middle span of the S-form transport path where it is supported by idler rollers 42. The web is conveyed under the array 24 of inkjet printheads which operate in sequence to print a composite image onto one surface of the web 12. The image is dried at a lower dryer 112 similar to the dryer 108. At the end of the middle span, the rightwardly driven web is turned though a reverse 180 degrees at roller pair 114*e*, 114*f*. From the roller pair 114*e*, 114*f*, the web is directed along the top span of the S-form transport path where it is supported by idler rollers 42 as passes under the top array 20 of inkjet printheads 56 which operate in sequence to print a composite image onto the upwardly facing surface of the web. Once the image is complete, it is dried at the upper drier 112 and then directed to and through the output zone 16.

Figure 7:
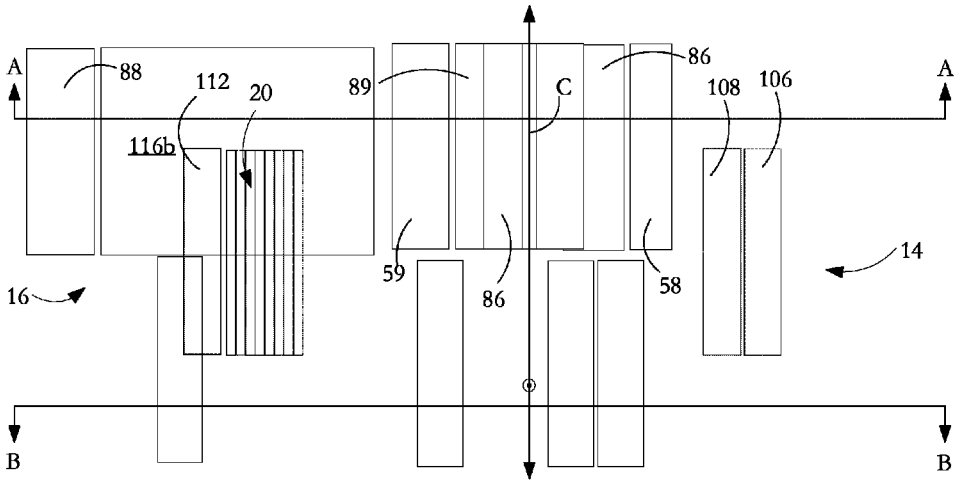
FIG. 7 is a plan view of a printing apparatus according to another embodiment of the invention.
Figure 8:
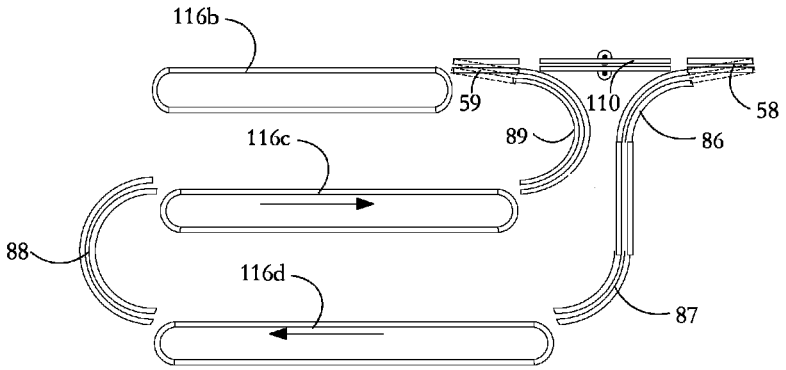
FIG. 8 is a schematic side sectional view on the line A-A of FIG. 7.
Figure 9:
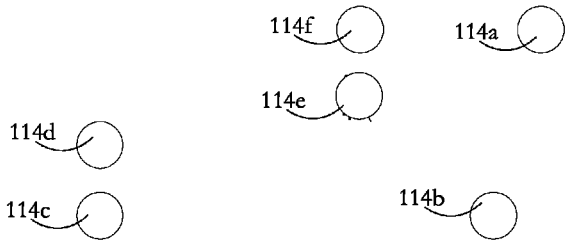
FIG. 9 is a schematic side sectional view on the line B-B of FIG. 7.

It will be appreciated that the arrangement illustrated in FIG. 1 provides a versatile apparatus for switching rapidly between a configuration adapted for simplex printing of sheet media and a configuration adapted for duplex printing of sheet media. Similarly, the arrangement described in FIG. 5 provides a versatile apparatus for switching rapidly between a configuration adapted for simplex printing of a web medium and a configuration adapted for duplex printing of a web medium. Printing operations are usually tailored either to cut sheet printing or to web printing. However, on occasion, there may be a need to switch a printing plant between printing sheet media and printing a web medium. Represented schematically in FIGS. 7, 8 and 9 is an arrangement which enables switching both between duplex and simplex printing and between cut sheet printing and web printing. In the schematic plan view of FIG. 7, there is shown, in outline, elements of the printing apparatus which are used in common for both cut sheet and web printing. These include an upper printhead array 20, a priming applicator 106 and dryer 108 at the input zone, and a dryer 112 at the output zone. A second priming applicator and dryer (not shown) occupy positions substantially the same as corresponding elements shown 106, 108 in the embodiment of FIG. 5. Other elements of the printing apparatus are mounted on a common carriage which is reciprocably slidable in the direction C and which, in FIG. 7, is shown in an intermediate position. Details of the carriage and a bearing arrangement to enable it to be slid relative to the common elements of the printer are not shown. On one side of the carriage, diverters 58, 59, bridging element 110 plus its associated roller nip, and turning units 86, 89 and belt 116*b* are used for sheet printing. The sheet printing elements also include at a lower level as shown in FIG. 8 turning units 87, 88 and belts 116*c*, 116*d*. On the other side of the carriage, rollers 114*a*, 114*b*, 114*d* and 114*f* and, at a lower level as shown in FIG. 9, rollers 114*c* and 114*e*, are used for web printing. The carriage and the elements supported by it are slid upwardly as shown in FIG. 7 to bring the sheet printing elements into registration with the common printing elements to enable sheet printing. Similarly, the carriage and the elements supported by it are slid downwardly as shown in FIG. 7 to bring the web printing elements into registration with the common printing elements to enable web printing.

Other variations and modifications will be apparent to those skilled in the art. The embodiments of the invention described and illustrated are not intended to be limiting. The principles of the invention contemplate many alternatives having advantages and properties evident in the exemplary embodiments.

What is claimed is:

1. A printer for selective duplex and simplex printing on a medium, comprising an input zone and an output zone, a transport mechanism having a selectable first transport path for transporting a medium from the input zone to the output zone past a first print station for printing on one surface of the medium by a first inkjet printhead, the transport mechanism having a second selectable transport path including a substantial part of the first transport path for transporting a medium from the input zone to the output zone past a second print station for printing on one surface of the medium by a second inkjet printhead and then past the first print station for printing on the reverse surface of the medium by the first ink jet printhead, the first and second transport paths including a first generally horizontal span at a first height, the first inkjet printhead positioned to jet ink down onto the medium as it is transported in a first direction along the first generally horizontal span the second transport path including a second generally horizontal span at a second height, the second inkjet printhead positioned to jet ink down onto the medium as it is transported in a second direction opposite to the first direction along the second generally horizontal span.

2. A printer as claimed in claim 1, further comprising a turn unit to turn a medium through 180 degrees between the horizontal spans.

3. A printer as claimed in claim 2, the first and second generally horizontal spans being vertically adjacent horizontals limbs of an S-form path.

4. A printer as claimed in claim 1, further including a drying unit mounted downstream of at least one of the inkier printheads.

5. A printer for selective duplex and simplex printing on sheet media, comprising an input zone and an output zone, a transport mechanism having a selectable first transport path for transporting sheet media from the input zone to the output zone past a first print station for printing on one surface of the sheet medium by a first inkjet printhead, the transport mechanism having a second selectable transport path including a substantial part of the first transport path for transporting sheet media from the input zone to the output zone past a second print station for printing on one surface of the sheet media by a second inkjet printhead and then past the first print station for printing on the reverse surface of the sheet media by the first ink jet printhead, the printer further comprising a first diverter drivable between a first position for passing sheet media from the input zone onto the first transport path and a second position for passing sheet media from the input zone onto the second transport path.

6. A printer as claimed in claim 5, further comprising a second diverter drivable between a third position for directing sheet media transported on the first transport path towards the output zone and a fourth position for directing sheet media transported on the second transport path towards the output zone.

7. A printer as claimed in claim 5, further comprising at least one continuous belt for transporting sheet media along at least one of the generally horizontal spans.

8. A printer as claimed in claim 1, further comprising a first priming unit and a first drying unit for priming and drying one surface of a medium transported on the first transport path and for priming and drying one surface of a medium transported on the second transport path.

9. A printer as claimed in claim 8, further comprising a second priming unit and a second drying unit for priming and drying a reverse surface of a medium transported on the second transport path.

10. A printer for selective duplex and simplex printing on a medium, comprising an input zone and an output zone, a transport mechanism having a selectable first transport path for transporting a medium from the input zone to the output zone past a first print station for printing on one surface of the medium by a first inkjet printhead, the transport mechanism having a second selectable transport path including a substantial part of the first transport path for transporting a medium from the input zone to the output zone past a second print station for printing on one surface of the medium by a second inkjet printhead and then past the first print station for printing on the reverse surface of the medium by the first ink jet printhead, the printer having first common transport elements operable to transport both sheet media and web media, second transport elements selectively operable to transport sheet media but not web media, and third transport elements selectively operable to transport web media but not sheet media.

11. A printer as claimed in claim 5, further including a drying unit mounted downstream of at least one of the inkjet printheads.

12. A printer as claimed in claim 5, further comprising a second diverter drivable between a third position for directing sheet media transported on the first transport path towards the output zone and a fourth position for directing sheet media transported on the second transport path towards the output zone.

13. A printer as claimed in claim 5, further comprising at least one continuous belt for transporting sheet media along at least one of the generally horizontal spans.

14. A printer as claimed in claim 5, further comprising a first priming unit and a first drying unit for priming and drying one surface of sheet media transported on the first transport path and for priming and drying one surface of a sheet media transported on the second transport path.

15. A printer as claimed in claim 14, further comprising a second priming unit and a second drying unit for priming and drying a reverse surface of a medium transported on the second transport path.

* * * * *